US006447872B1

(12) United States Patent
Larson

(10) Patent No.: US 6,447,872 B1
(45) Date of Patent: Sep. 10, 2002

(54) REINFORCED CORNER BEAD

(75) Inventor: John A. Larson, Parkland, FL (US)

(73) Assignee: Plastic Components, Inc., Miami, FL (US)

( * ) Notice: Subject to any disclaimer, the term of this patent is extended or adjusted under 35 U.S.C. 154(b) by 104 days.

(21) Appl. No.: 09/644,520

(22) Filed: Aug. 24, 2000

(51) Int. Cl.[7] ..... B32B 3/14; B32B 3/04; E04B 2/00

(52) U.S. Cl. ..... 428/77; 428/83; 428/122; 428/172; 52/255; 52/287.1; 52/417

(58) Field of Search ..... 428/156, 172, 428/77, 83, 122; 52/287.1, 417, 255, 257

(56) References Cited

U.S. PATENT DOCUMENTS 3,900,550 A * 8/1975 Oliver et al. ..... 264/320
5,442,886 A * 8/1995 Iacobelli ..... 52/255

* cited by examiner

*Primary Examiner*—Donald J. Loney

(57) ABSTRACT

A flexible and resilient plastic corner bead of the type used in the installation of gypsum, foam and other similar construction board comprising a pair of integral flanges joined by an integrally formed plastic hinge and having adhered to at least one surface thereof, a fiberglass mesh that extends beyond the lateral edges of the flanges of the corner bead.

6 Claims, 3 Drawing Sheets

REINFORCED CORNER BEAD

FIELD OF THE INVENTION

The present invention relates to an improved corner bead of the type used in the installation and finishing of, for example gypsum board of the like, and more particularly to such a corner bead that is reinforced with a mesh.

BACKGROUND OF THE INVENTION

Numerous solutions to the problem of providing a flexible, resilient, long lasting and easily installed corner bead have been proposed. Metallic corner bead served as the standard for many years, but often proved difficult to install over irregularly shaped corners because of the relative inflexibility of such materials. The introduction of plastic corner bead materials that could be relatively easily flexed and bent to generally conform to the shape of even the most irregularly shaped walls solved many of the problems inherent with metallic corner bead but introduced yet another problem, namely adhesion of the dry wall mud or other finishing materials to the relatively "slick" and non-adherent surfaces of plastics. This problem, in turn, was "solved" by the placement of holes in the plastic corner bead that permitted over-applied finishing materials to hold the plastic corner bead by infiltrating the holes and thus better holding the finishing material to the plastic corner bead. Often however, the finishing material tended to ooze from the holes before drying and resulted in a "bumpy" finish that required the application of an additional coating of finishing materials to render the corner surface acceptably smooth prior to application of the final finish coat. Such an additional step was both time consuming and costly in the highly competitive and deadline oriented construction industry.

Thus, a corner bead that provides all of the advantages of flexible/resilient plastic while not having the problems related to finishing material adhesion just described would be of significant value in the construction industry.

OBJECT OF THE INVENTION

It is therefore an object of the present invention to provide an enhanced corner bead that provides excellent adhesion of over-applied finishing materials without the need for additional treatment steps.

SUMMARY OF THE INVENTION

According to the present invention, there is provided a flexible and resilient corner bead of the type used in the installation of gypsum, foam and other similar construction board comprising a pair of integral flanges joined by an integrally formed plastic hinge and having adhered to at least one surface thereof, a fiberglass mesh that extends beyond the lateral edges of the flanges of the corner bead. The corner bead of the present invention is supplied in a planar configuration capable of being bent along the hinge to conform to the shape of either a concave or a convex corner.

DETAILED DESCRIPTION

Figure 2:
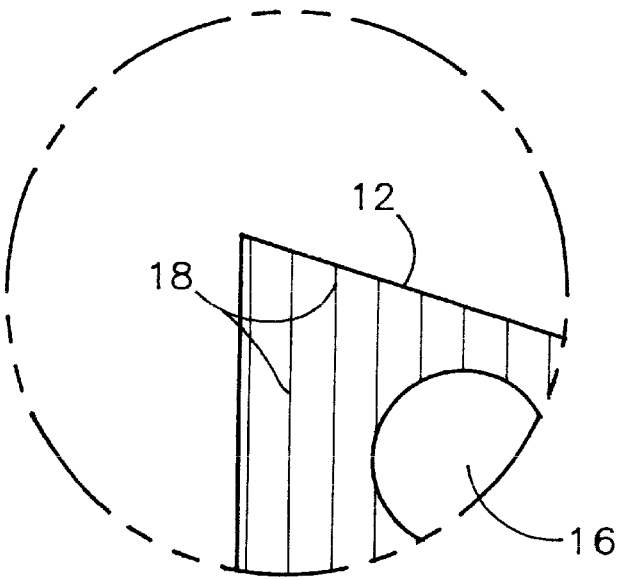
FIG. 2 is a detailed view of the front surface of the plastic corner bead of the present invention.
Figure 1:
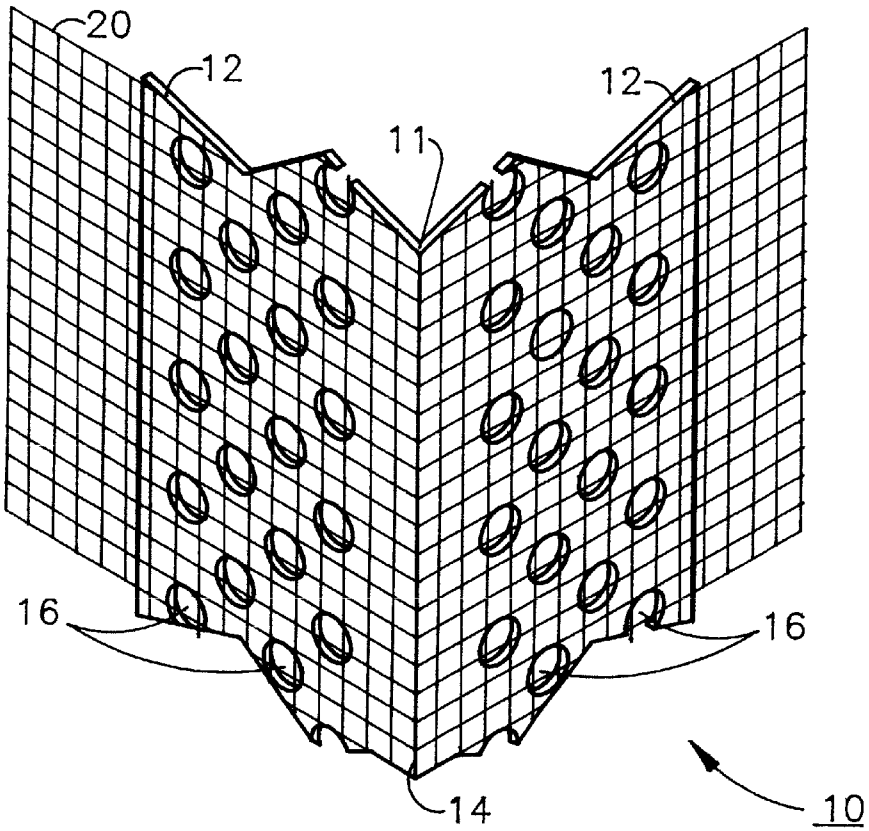
FIG. 1 is a perspective view of the corner bead of the present invention.
Figure 3:
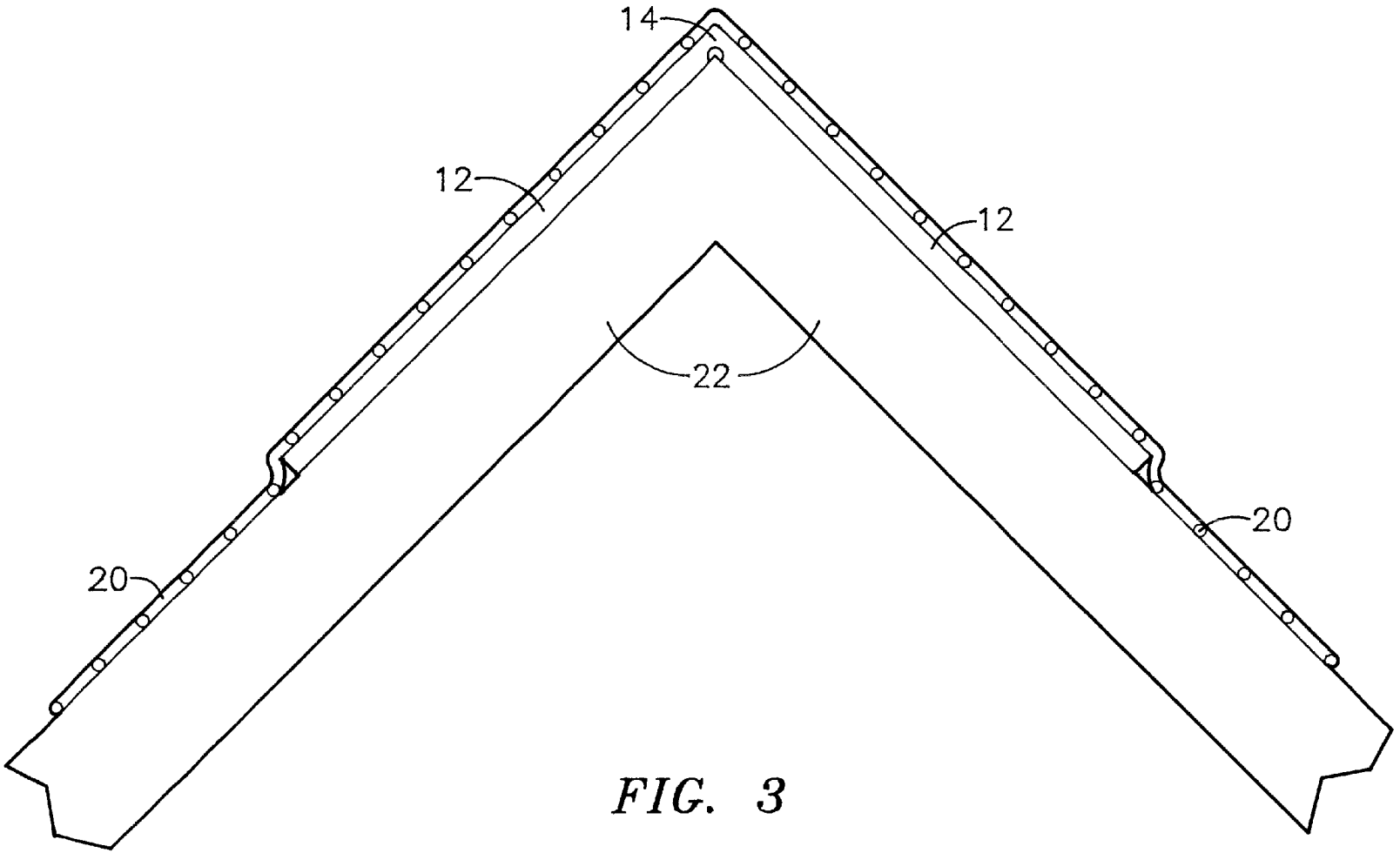
FIG. 3 is a cross-sectional view of one embodiment of the improved corner bead of the present invention installed on a convex corner.
Figure 5:
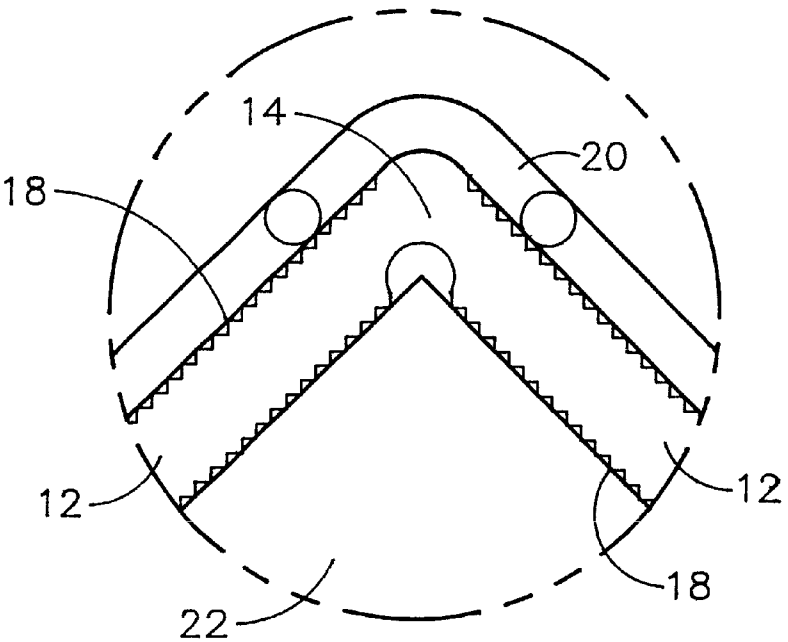
FIG. 5 is a detailed view of the hinge area of the corner bead of the present invention installed as shown in FIG. 3.
Figure 4:
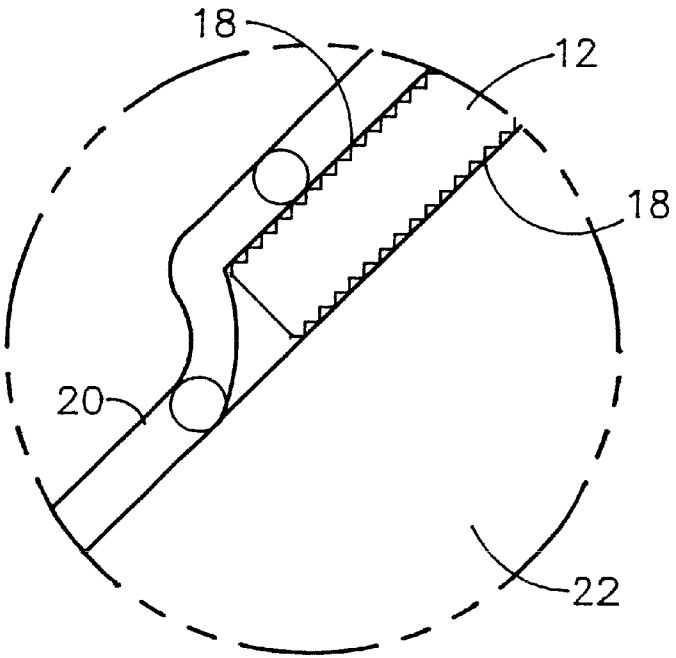
FIG. 4 is a detailed view of the area of contact between various elements of the corner bead of the present invention and an underlying surface to which it as been applied upon installation as shown in FIG. 3.

Referring now to FIGS. 1 and 3, the corner bead 10 of the present invention comprises a plastic corner bead structure 11 made up of a pair of integral flanges 12 joined by an integral hinge 14. Each of flanges 12 incorporates a series of holes 16 that permit the infiltration of finishing material such as dry wall mud or joint compound during installation and finishing, as were provided in prior art such corner bead devices. Striations 18 are preferably incorporated into at least the outward facing surfaces of flanges 12, but preferably of both surfaces of flanges 12 to improve adhesion of over-applied finishing material. Adhered or laminated to at least the "outer" surface of corner bead 10, i.e. that surface that faces the outside of the wall after installation as shown in FIG. 2, is a fiberglass mesh 20. In the embodiment depicted in FIGS. 2 and 3, corner bead 10 is applied over a substrate such as gypsum board or foam board 22.

According to various preferred embodiments of the present invention, flanges 12 are about 2.5 inches wide, there are four rows of holes 16 and holes 16 are about ¼ inch in diameter and the overall width of fiberglass mesh 20 is between about 8 and about 12 inches. The apertures of fiberglass mesh 20 are rectangles preferably between about ⅛ by ⅛, inches and about ⅜ by ⅜ inches. Corner bead 10 is preferably supplied as a planar or flat structure that is applied as shown in. FIGS. 1 and 3 by bending about a corner to be protected.

The above-described structure provides numerous advantages over prior art corner bead structures that do not include adherent fiberglass mesh 20. For example, fiberglass mesh 20 provides additional apertures for the infiltration of the over-applied dry wall mud, joint compound or other finishing material thereby providing improved adhesion of these materials to the "slick" surface of the plastic corner bead. Also, because the apertures in fiberglass mesh 20 are of a relatively fine size and the mesh overall is quite thin (on the order of about 20–100 mils), the prior art problem of leakage or "bleeding" of freshly applied dry wall mud or joint compound from these apertures is not a problem, as the dry wall mud or joint compound is retained in holes 16 by mesh 20. Thus adhesion of corner bead 10 to the surface to which it is applied is further improved.

The use of a fiberglass mesh provides the appropriate flexibility such that when corner bead 10 which is conventionally supplied as a planar or flat element is bent to conform to the shape of a convex or concave corner, the mesh can similarly flex and stretch as necessary to meet the conformance requirements.

Fiberglass mesh 20 can be adhered to plastic corner bead 11 using any appropriate adhesive or preferably by lamination through the application of controlled heat to the combined plastic corner bead and fiberglass mesh while pressure is being applied according to-well known techniques. When plastic corner bead 10 is fabricated from for example PVC, a conventional PVC adhesive of the type conventionally available and well known in the art may be used to adhere mesh 20 to plastic corner bead structure 11.

Although the shape of integral hinge 14 may be varied considerably, it is preferred that the thickness of material in the area of integral hinge 14 be reduced from that of flanges 12 as best shown in FIGS. 1 and 3. This permits the formation of a relatively smooth bead on the face of corner bead 11 when bent to conform to a corner whether concave or convex while also providing an area of reduced strength in the nature of a score line to allow easier straight line bending.

While the advantages that accrue by virtue of the presence of mesh 20 can be realized through the use of only a single layer of mesh 20 on one side of corner bead 10, it will be apparent to the skilled artisan that in certain applications the use of two layers of mesh 20, one on either side of corner bead 10 is equally possible and contemplated as within the scope of the instant invention. When a single layer of fiberglass mesh 20 is used, it is preferred that it address the outside surface, i.e. that surface facing away from the wall, corner or other surface to which corner bead 10 is being applied.

As the invention has been described, it will be apparent to those skilled in the art that the same may be varied in many ways without departing from the spirit and scope of the invention. Any and all such modifications are intended to be within the scope of the appended claims.

What is claimed is:

1. A flexible plastic corner bead for application in the finishing of corners in drywall, foam panel walls and the like construction comprising;

a) a pair of integral, longitudinal lateral flanges having a defined thickness joined by;

b) an integrally formed and flexible longitudinal hinge portion having an inside surface and an outside surface defined by proximity to a wall being finished to which said corner bead is applied, said inside surface having a longitudinal indentation providing a region of reduced thickness from that of said flanges; and c) a fiberglass mesh adhered or laminated over the entirety of at least one of said inside or outside surfaces of said flanges and said hinge, said fiberglass mesh extending laterally beyond said flanges.

2. The plastic corner bead of claim 1 that is substantially planar in configuration.

3. The plastic corner bead of claim 2 wherein said fiberglass mesh comprises rectangular openings within the range of from about ⅛ by ⅛ to about ⅜ by ⅜.

4. The plastic corner bead of claim 2 wherein said flanges have front and rear surfaces and at least one of said front and rear surfaces include longitudinal striations.

5. The corner bead of claim 2 wherein said flanges are each about 2 ½ inches wide and said fiberglass mesh is between about 8 and 12 inches wide.

6. The flexible plastic corner bead of claim 1 wherein said outside surface defines a square corner when applied over a corner to be finished.

* * * * *